US012403408B2

(12) United States Patent
Kosoy

(10) Patent No.: US 12,403,408 B2
(45) Date of Patent: Sep. 2, 2025

(54) PROGRAMMABLE DOLL ASSEMBLY

(71) Applicant: E-liza Dolls LLC, Albany, CA (US)

(72) Inventor: Eliza Kosoy, Albany, CA (US)

(73) Assignee: E-liza Dolls LLC, Albany, CA (US)

( * ) Notice: Subject to any disclaimer, the term of this patent is extended or adjusted under 35 U.S.C. 154(b) by 0 days.

(21) Appl. No.: 17/300,335

(22) Filed: May 18, 2023

(65) Prior Publication Data

US 2025/0065239 A1 Feb. 27, 2025

Related U.S. Application Data

(60) Provisional application No. 63/343,223, filed on May 18, 2022.

(51) Int. Cl.
*A63H 3/36* (2006.01)

(52) U.S. Cl.
CPC ..... *A63H 3/36* (2013.01)

(58) Field of Classification Search
None
See application file for complete search history.

(56) References Cited

U.S. PATENT DOCUMENTS 4,268,991 A * 5/1981 Cotey ..... A63H 3/46 446/373
6,053,797 A * 4/2000 Tsang ..... A63H 3/28 446/297
6,435,937 B1 * 8/2002 Naegele ..... A63B 21/152 446/298
6,471,565 B2 * 10/2002 Simeray ..... A63H 33/00 446/298
6,554,679 B1 * 4/2003 Shackelford ..... A63H 3/28 446/268
8,287,327 B1 * 10/2012 Ghaly ..... A63H 3/52 446/330
9,390,626 B1 * 7/2016 Horowitz ..... G09B 5/00
(Continued)

FOREIGN PATENT DOCUMENTS

CN 109464819 A * 3/2019 ..... A63H 3/28
WO WO-2017120180 A1 * 7/2017 ..... A63H 11/00

OTHER PUBLICATIONS

Eliza Kosoy, E-liza Dolls Kickstarter video, Jan. 12, 2021, https://www.youtube.com/watch?v=bHJJKW-s6yl , p. 1, time 0:00-3:34 (Year: 2021).*

*Primary Examiner* — Tramar Harper
(74) *Attorney, Agent, or Firm* — Run 8 Patent Group, LLC; Peter Miller; Leah Raddatz

(57) ABSTRACT

One variation of a doll assembly includes a doll and a sensor kit. The doll includes: a body; a set of connector receptacles arranged on the body; a core receptacle arranged within the body; and a control unit configured to engage the core receptacle to electrically couple to the set of connector receptacles. The sensor kit includes a first accessory, in a suite of accessories, including: a connector configured to transiently engage a connector receptacle in the set of connector receptacles; and a color sensor configured to output a signal representing a color of an object arranged within a field of view of the color sensor. The control unit is configured to receive the signal and trigger generation of a detectable response, indicating the color of the object, according to instructions programmed by a user and received from a companion application executing on a computing device accessed by the user.

2 Claims, 3 Drawing Sheets

(56) References Cited

U.S. PATENT DOCUMENTS

| | | | | |
|---|---|---|---|---|
| 2001/0041495 | A1* | 11/2001 | Chan | A63H 3/16<br>446/268 |
| 2001/0041496 | A1* | 11/2001 | Smirnov | A63H 3/28<br>446/175 |
| 2002/0086607 | A1* | 7/2002 | Chan | A63H 3/28<br>446/175 |
| 2002/0164922 | A1* | 11/2002 | Willett | A63H 3/48<br>446/330 |
| 2003/0157865 | A1* | 8/2003 | Pacza-Steim | A63H 3/00<br>446/484 |
| 2003/0162475 | A1* | 8/2003 | Pratte | A63H 3/28<br>446/175 |
| 2004/0043696 | A1* | 3/2004 | Suzuki | A63H 3/28<br>446/268 |
| 2004/0119342 | A1* | 6/2004 | Sato | G01D 5/2405<br>307/652 |
| 2004/0214642 | A1* | 10/2004 | Beck | A63H 3/28<br>463/40 |
| 2006/0068366 | A1* | 3/2006 | Chan | A63H 3/52<br>434/169 |
| 2006/0217030 | A1* | 9/2006 | Lashinsky | A63H 3/46<br>446/376 |
| 2007/0093170 | A1* | 4/2007 | Zheng | A63H 3/50<br>446/268 |
| 2007/0128979 | A1* | 6/2007 | Shackelford | A63H 3/365<br>446/484 |
| 2011/0159963 | A1* | 6/2011 | Link | A63H 3/003<br>463/40 |
| 2013/0288560 | A1* | 10/2013 | Abou-Hamda | G05D 1/0234<br>446/175 |
| 2014/0002831 | A1* | 1/2014 | Hernandez | A63H 33/26<br>358/1.9 |

* cited by examiner

PROGRAMMABLE DOLL ASSEMBLY

CROSS-REFERENCE TO RELATED APPLICATIONS

This Application claims the benefit of U.S. Provisional Application No. 63/343,223, filed on 18 May 2022, which is incorporated in its entirety by this reference.

TECHNICAL FIELD

This invention relates generally to the field of educational toys and more specifically to a new and useful programmable doll and sensor assembly in the field of educational toys.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Doll Assembly: Doll+Sensor Kit

Figure 1:
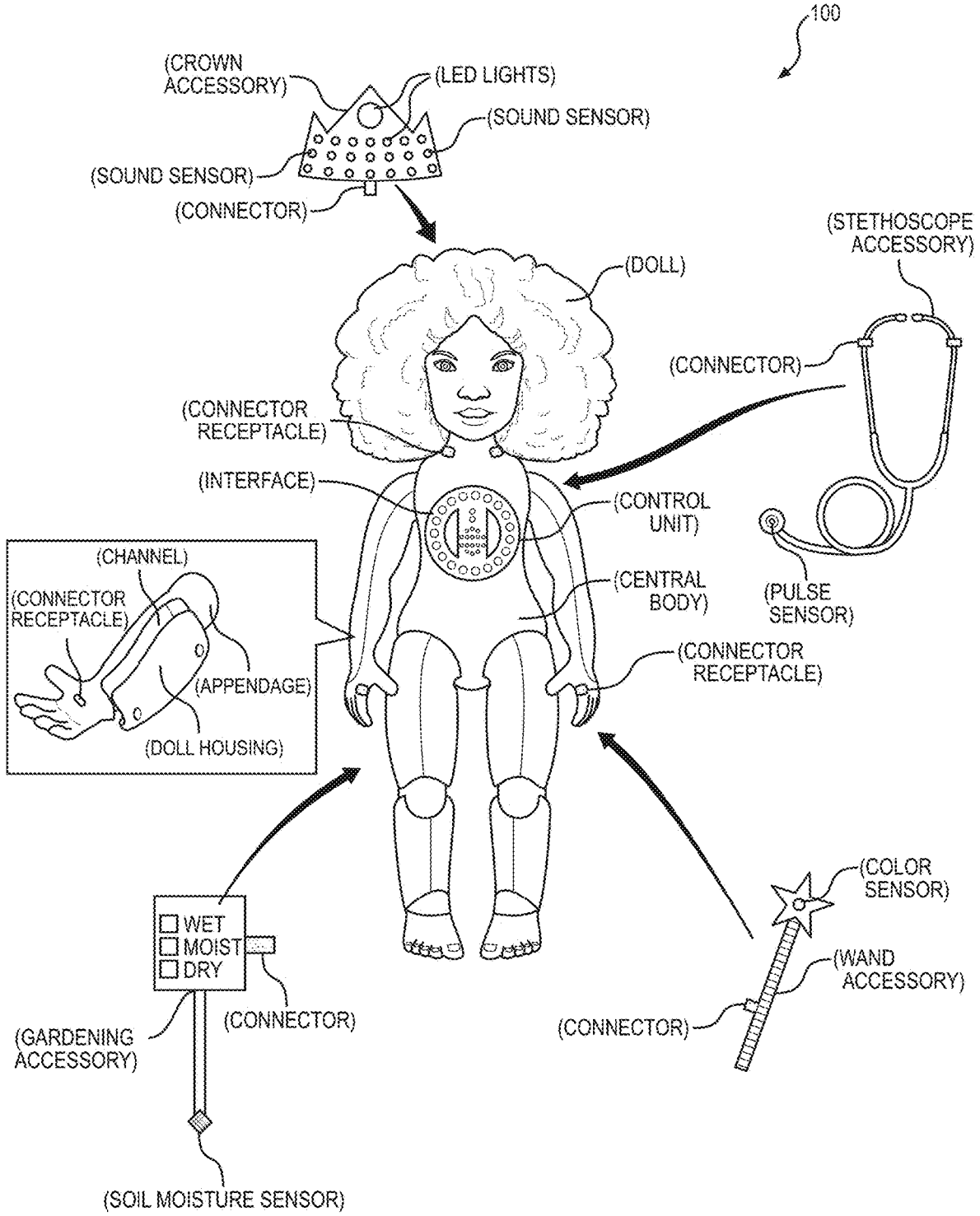
FIG. 1 is a schematic representation of a doll assembly.
Figure 2:
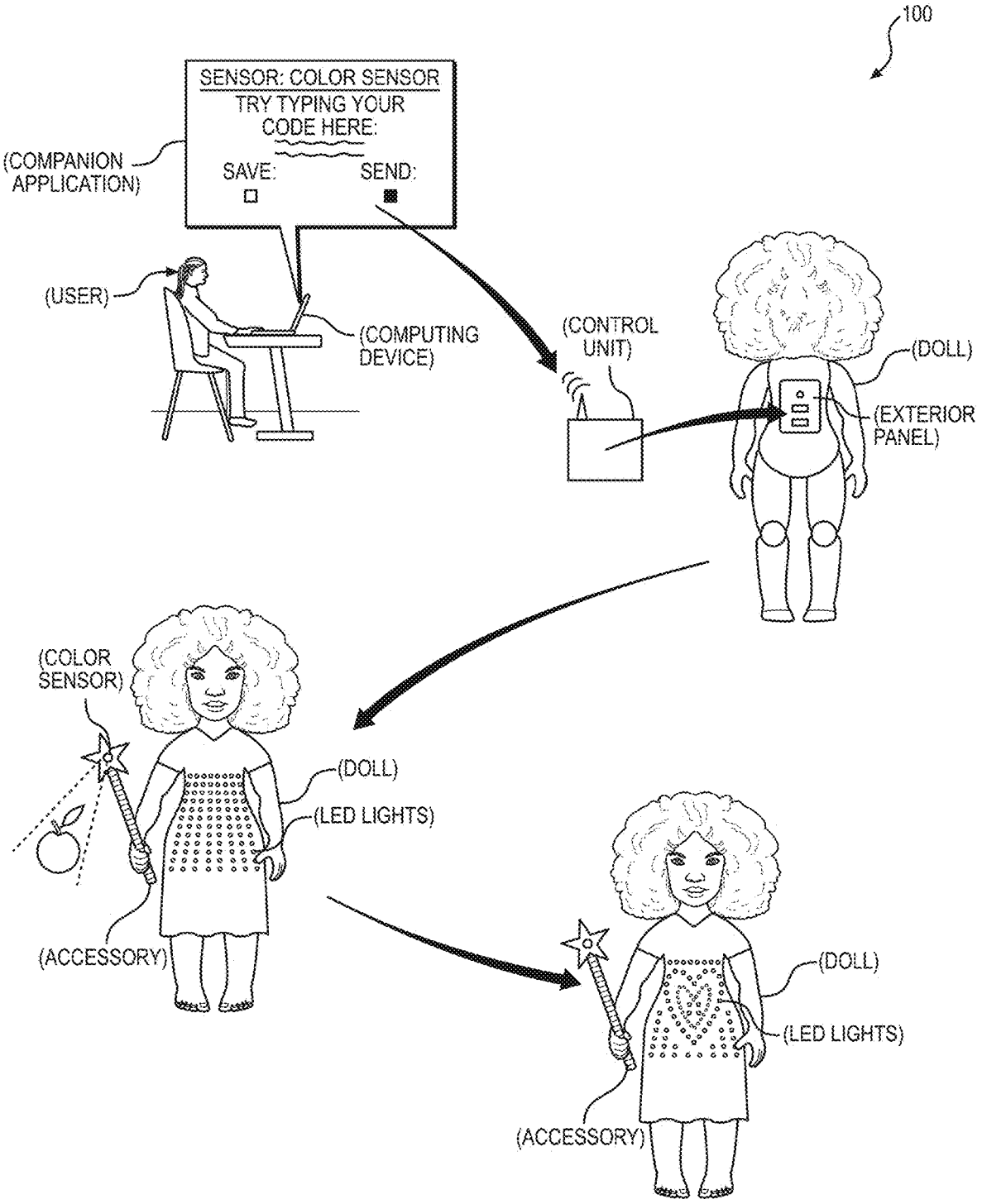
FIG. 2 is a schematic representation of the doll assembly.
Figure 3A:
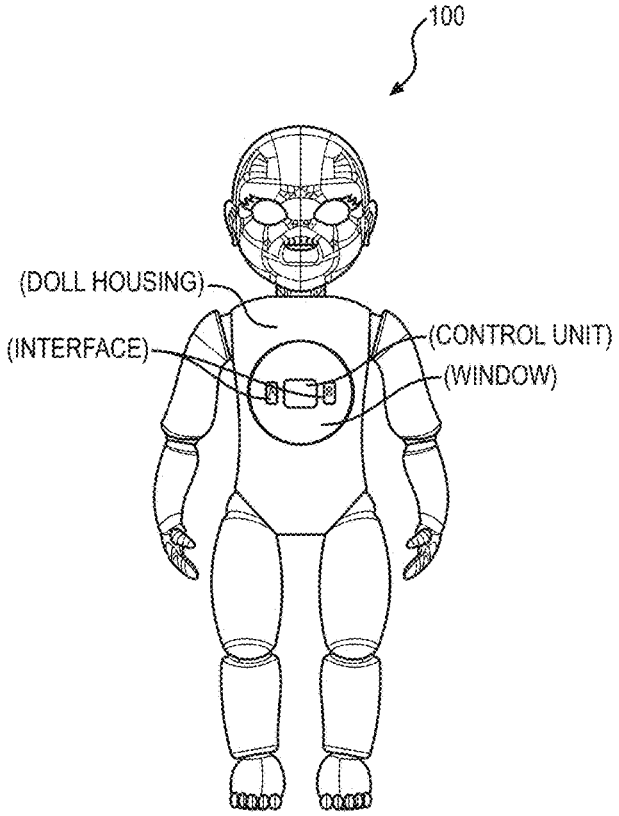
FIGS. 3A and 3B are schematic representations of the doll assembly.
Figure 3B:
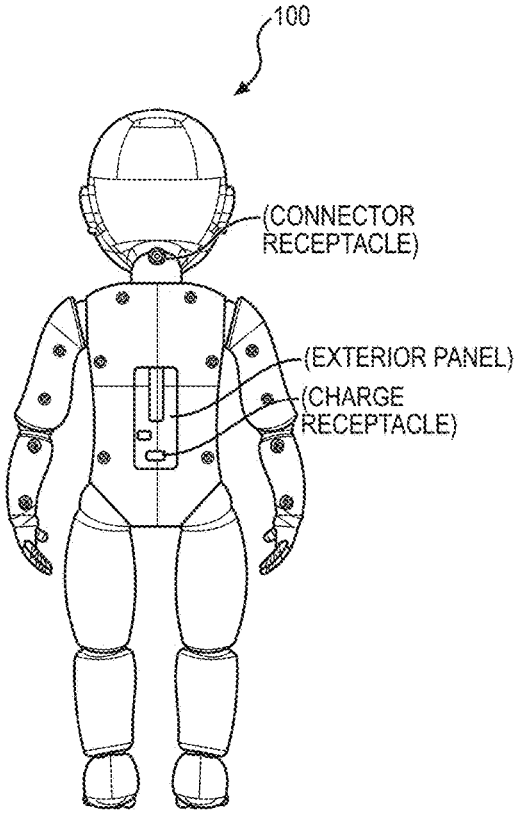
Figure 4:
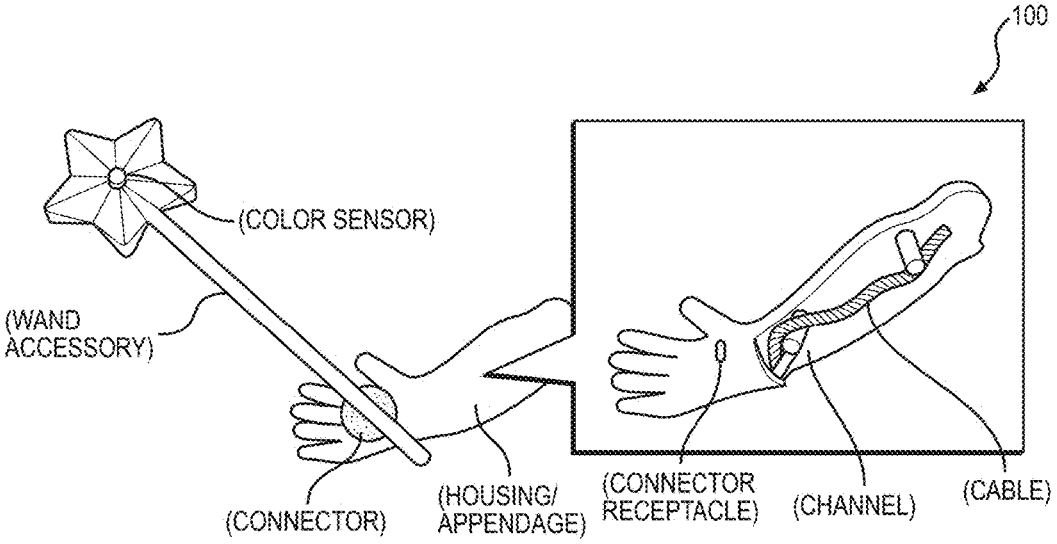
FIG. 4 is a schematic representation of the doll assembly.

As shown in FIGS. 1-4, a programmable doll assembly 100 includes a doll; and a sensor kit. The doll includes a doll housing (e.g., forming a body of the doll) including: a set of connector receptacles (e.g., a USB port, an audio jack); a central body (e.g., a torso of the doll) defining a central cavity; and a set of appendages (e.g., arms, legs, and/or head of the doll) flexibly coupled with the central body and defining a set of channels extending from the central cavity toward the set of connector receptacles. The doll further includes: a core receptacle arranged within the central cavity; a control unit configured to transiently engage the core receptacle to seat within the central cavity; and a set of cable connectors—configured to seat within the set of channels—defining a first end, configured to couple to the control unit, and a second end, configured to couple to the set of connector receptacles.

The control unit includes: a processor (e.g., a microprocessor) configured to process signals (e.g., electrical signals) according to a set of instructions programmed by a user and received from a companion application executing on a computing device accessed by the user; a communication module (e.g., an antenna) configured to enable wireless communication between the control unit and the companion application; a power supply configured to supply power to the doll assembly 100 including the control unit and sensors of the sensor kit; and an edge connector configured to receive the set of cable connectors to electrically couple the set of connector receptacles to the control unit.

The sensor kit includes a first accessory, in a set of accessories, including: a first connector (e.g., a USB connector) configured to transiently engage a first connector receptacle (e.g., a USB port), in the set of connector receptacles, to electrically couple the first accessory to the control unit; and a color sensor configured to output a first signal (e.g., an electrical signal), to the control unit, responsive to presence of a first object of a first color in field of view of the color sensor, and configured to output a second signal, to the control unit, responsive to presence of a second object of a second color in the field of view of the color sensor. The control unit can be configured to: trigger generation of a first detectable response—associated with presence of the first color—responsive to receiving the first signal, based on a first subset of instructions, in the set of instructions, corresponding to the color sensor; and trigger generation of a second detectable response—associated with presence of the second color—responsive to receiving the second signal, based on the first subset of instructions.

The sensor kit can further include a second accessory, in the set of accessories, including: a second connector configured to transiently engage a second connector receptacle, in the set of connector receptacles, to electrically couple the second accessory to the control unit; and a moisture sensor configured to output a third signal, to the control unit, responsive to detection of a first moisture level in soil, and, output a fourth signal, to the control unit, responsive to detection of a second moisture level in soil. The control unit can be configured to: trigger generation of a third detectable response—associated with the first moisture level—responsive to receiving the third signal, based on a second subset of instructions, in the set of instructions, corresponding to the moisture sensor; and trigger generation of a fourth detectable response—associated with the second moisture level—responsive to receiving the fourth signal, based on the second subset of instructions.

In one variation, the sensor kit can further include a third accessory, in the set of accessories, including: a third connector configured to transiently engage a third connector receptacle, in the set of connector receptacles, to electrically couple the third accessory to the control unit; and a sound sensor configured to output a third signal, to the control unit, responsive to detection of a first noise level in an environment containing the second sensor, and, output a fourth signal, to the control unit, responsive to detection of a second noise level in the environment containing the second sensor. The control unit can be configured to: trigger generation of a third detectable response—associated with the first noise level—responsive to receiving the third signal, based on a second subset of instructions, in the set of instructions, corresponding to the sound sensor; and trigger generation of a fourth detectable response—associated with the second noise level—responsive to receiving the fourth signal, based on the second subset of instructions.

2. Applications

Generally, a companion application (e.g., executing on a computing device)—in combination with a programmable doll assembly 100 (hereinafter "doll assembly" 100) including an electronic doll and a sensor kit including a suite of programmable sensors and/or doll accessories—can be configured to: provide instructions for programming the doll and/or the suite of sensors—integrated into accessories removably coupled to the doll—to generate customizable and detectable responses based on external stimuli present in an environment containing the doll; promote engagement of the user with the doll assembly 100 by integrating these programmable sensors into accessories associated with tasks and/or activities (e.g., gardening, attending school, completing chores, playing with friends, imaginary play) associated with and/or enjoyed by children (e.g., young girls); and promote learning of various skills related to science, technology, engineering, and/or mathematics by incorporating activities—configured to teach these various skills—into programming tutorials and/or tasks executed by the user with her doll and/or sensor kit.

In particular, the doll assembly 100 can include a doll configured to: exhibit features (e.g., body shape, facial features, hair features) resembling features of a young human (e.g., a toddler, early childhood human, preadolescent human); engage and retain a set of detachable accessories—including a set of sensors programmable by the user—transiently attached to the doll by the user; and house a central control unit (e.g., a set of electronics arranged on a printed circuit board) configured to coordinate processing of signals from the set sensors, coupled to the doll housing, based on instructions programmed (e.g., coded) by the user. The doll assembly 100 can also include a sensor kit including the set of detachable accessories configured to couple with the doll, such that the user may readily mix and match and/or customize accessories currently coupled to the doll. Each accessory can include a sensor configured to: detect a set of environmental conditions or stimuli present in a surrounding environment; and output a signal (e.g., an electrical signal) to the control unit representing these environmental conditions or stimuli.

In one example, the user (e.g., a child)—such as an early childhood, play age, and/or preadolescent girl—can access the companion application executing on a computing device (e.g., a smart phone, a tablet, a laptop, a desktop computer) of the user and/or of an adult supervisor (e.g., a parent, a grandparent, a teacher). The user may view a tutorial configured to enable the user to code a program configured to trigger a necklace accessory—including a set of LED lights—"worn" by (e.g., coupled to) the user's doll to emit light of a particular color responsive to detection of the particular color at a color sensor integrated into a "magic wand" accessory "held" by (e.g., coupled to) the user's doll. In particular, the user may couple the necklace accessory to the doll by inserting a connector (e.g., a USB connector, an auxiliary jack) of the necklace accessory into a corresponding connector receptacle (e.g., a USB port) of the doll, thereby electrically coupling the set of LED lights of the necklace accessory to the control unit of the doll. The user may similarly couple the magic wand accessory to the doll's hand to electrically couple the color sensor to the control unit. Then, within the companion application, the user may write her own program configured to enable operation of the color sensor and the set of LED lights according to the tutorial.

Upon completion of the writing the program, the user may initiate transfer of the program onto the control unit of her doll, such as via wireless transfer (e.g., via Bluetooth) and/or by physically connecting her doll to the computing device. Once loaded, the user may test operation of the color sensor and/or play with her doll by holding the magic wand proximal objects of varying colors and viewing changes in color of the light emitted by the set of LED lights of the necklace accessory accordingly, such as by matching the doll's necklace to a color of the user's outfit and/or to the user's favorite colors.

The system can therefore both enable the user to learn how to write these programs—and thereby control operation of the doll and the doll's accessories—while encouraging the user to enjoy the results of her work by engaging in play with her doll and these accessories.

3. Doll

The doll can include: a doll housing (e.g., forming a body of the doll) including a central body (e.g., a torso of the doll)—defining a central cavity—and a set of appendages (e.g., a head, a pair of arms, and a pair of legs of the doll)—defining a set of channels extending from the central cavity—flexibly coupled with the central body; a core receptacle arranged within the central cavity of the doll housing (hereinafter "housing") and configured to transiently engage and retain the control unit within the central cavity; and a set of connector receptacles—arranged on the central body and/or the set of appendages of the housing—configured to mate with corresponding connectors (e.g., USB connector, an aux cord) of the set of accessories to enable coupling of these accessories and/or sensors to the housing and the central control unit. The doll can also include a power supply (e.g., a battery pack) arranged within the central cavity (e.g., coupled to the control unit) configured to supply power to the control unit and the set of accessories and/or sensors coupled to the doll.

For example, the doll can include: a first set of connector receptacles arranged on the doll's ears and configured to mate with a first set of connectors arranged on a first set of accessories—such as a pair of earrings and/or a pair of headphones—configured to be worn by the doll; a second set of connector receptacles arranged on the doll's palms and configured to mate with a second set of connectors arranged on a second set of accessories—such as a wand, a soil moisture meter, and/or a musical instrument—configured to be held by the doll; and a third set of connector receptacles arranged on the doll's neck and configured to mate with a third set of connectors arranged on a third set of accessories—such as a scarf, a necklace, and/or stethoscope—configured to be worn by the doll.

In one implementation, the doll can include an exterior panel arranged on the housing. The exterior panel can be configured to seat flush with an exterior surface of the central body in a closed position, such that the surface of the housing appears smooth and/or continuous. In this implementation, the exterior panel can include: a charge receptacle configured to couple with an external charging element; a power control (e.g., a power switch) configured to enable the user to activate and/or deactivate the power supply of the doll; and/or a connector receptacle configured to transiently receive a connector electrically coupled to a computing device (e.g., a desktop computer) of the user, thereby enabling transfer of data from the companion application executing on the computing device of the user to the control unit. The exterior panel can therefore be electrically coupled (e.g., via a flex cable) with the control unit to enable transfer of charge from the external charging element to the power supply within the doll. Additionally, and/or alternatively, in one variation, the exterior panel can be removably coupled from the central body of the housing and configured to enable user access to the central cavity for removal and/or insertion of the control unit.

In one implementation, the housing can be configured to minimize disruption in operation of the set of sensors due to bending and/or breakage of cables connecting the control unit to the set of connector receptacles. In particular, the set of appendages (e.g., arms, legs, neck, head) can include a set of channels extending from the central cavity of the central body toward the set of connector receptacles. The doll can include a set of cables—each cable transiently and/or permanently coupled with the control unit at a first end and a connector receptacle at a second end—configured to seat within the set of channels. These channels can therefore be configured to minimize tangling and/or movement of cables within the channels. Further, the housing can be configured to minimize movements of the set of appendages and/or the central body along cable pathways. For example, the central body can be configured to cooperate with the arms of the doll to enable shoulder movement, such as rotation of the arm relative a shoulder socket defined by the central body. However, the wrists of the doll can be configured to exhibit minimal movement (e.g., bending) to prevent bending of cables extending to connector receptacles arranged in the hands of the doll.

3.1 Control Unit

The doll assembly 100 can include a control unit installed within the central cavity of the housing and configured to process signals received from the set of sensors according to instructions programmed by the user (e.g., within the companion application executing on the user's computing device).

In one implementation, the control unit can include: a printed circuit board (or "PCB"); a processor (e.g., a microprocessor) arranged on the PCB and configured to process information received from the set of sensors and trigger output of detectable responses according to instructions received (e.g., programmed by the user) from the companion application executing on the user's computing device; a communication module (e.g., an antenna) configured to enable wireless communication (e.g., via Bluetooth) between the control unit, the companion application executing on the user's computing device, and/or a second control unit installed in a second doll; a power supply (e.g., batteries) coupled to the PCB and configured to supply power to electronic components of the doll assembly 100 (e.g., including the control unit); and an edge connector configured to enable coupling of the control unit to the set of accessories attached to the housing via the set of connector receptacles.

Additionally, in another implementation, the control unit can be configured to include a set of fixed sensors (e.g., integrated within the PCB), such as: a speaker configured to output sounds; a microphone configured to detect and/or record external sounds (e.g., output by the user and/or in the user's environment); an accelerometer; and/or a compass.

3.1.2 Doll Interface

In one implementation, the control unit can include an interface (e.g., arranged on a surface of the PCB opposite the processor and communication module)—viewable by the user—arranged on the central body of the housing. In this implementation, the interface of the control unit can further include a display—including an array of LED lights—viewable by the user via the window; and a set of input features (e.g., buttons) selectable and programmable by the user.

In particular, the housing can define an aperture arranged on the central body proximal the core receptacle—configured to engage and retain the control unit—of the central cavity. The interface can be configured to seat within this aperture on the central body. Further, the doll can include a window (e.g., a clear, plastic panel)—arranged over the interface and within the cutout (e.g., such that the housing and the window form a cohesive, unitary structure)—configured to protect electronics on the control unit and/or within the housing, while enabling the user to view the interface of the control unit. The window can therefore be configured to enable user contact with the set of input features while preventing user contact with the display and/or preventing access to the interior of the housing.

In one variation, the interface of the doll can be decoupled from the control unit. In this variation, the interface can include a digital display—distinct from the control unit—arranged on the housing. For example, the doll can include an LED or LCD display integrated within the aperture of the housing. In this example, the control unit can seat within the central cavity of the housing and beneath the LCD display. Further, the digital display can be coupled to the control unit (e.g., via electrical wire or cable), such that the user may write and/or upload instructions to the control unit to control outputs (e.g., visual output) of the digital display.

In one variation, the doll can further include a light ring-including a set of LED lights arranged in a circular pattern about the interface-programmable by the user.

3.1.3 Game Play

In one variation, the control unit can be configured to enable the user to play games with her doll by rendering content on the display of the interface, based on instructions programmed by the user (e.g., within the companion application) and stored at the control unit. For example, the user may code a program configured to generate a random number between one and six in response to the user shaking her doll. In this example, the control unit can include an accelerometer configured to measure acceleration of the doll. Therefore, the user may code the program to: generate the random number when the doll's acceleration exceeds a threshold acceleration; and render the random number on the display of the interface. The user may then upload this program to the control unit and—independently and/or with a friend(s), sibling(s), parent(s), etc.—shake her doll to "roll a die" and view the random number generated on the display, accordingly. The control unit can similarly be configured to enable playing of other games and/or activities according to instructions programmed by the user.

3.1.4 Pairing of Dolls

In one implementation, the communication module can be configured to enable communication between multiple dolls. For example, the user may pair her doll (e.g., via Bluetooth) with her sister's doll, such that the user and her sister may play together with their dolls. In particular, in this example, by pairing her doll to her sister's doll, the user may: transmit a particular message for rendering on a display of her sister's doll by pressing a button on her own doll's interface; match a color of her doll's dress to a color of her sister's doll's dress; and/or share a program coded by the user for her own doll with her sister's doll for execution. The system can therefore encourage these users to play together with their dolls, thereby promoting engagement of the user with the dolls and corresponding educational content.

4. Sensor Kit

The doll assembly 100 can include a sensor kit including a set of accessories configured to couple with the housing, such that the user may readily mix and match and/or customize accessories currently coupled to the doll. In particular, each accessory can include: a connector (e.g., a USB connector) configured to engage a corresponding connector receptacle on the housing to couple the accessory to the doll; and a sensor configured to detect a set of environmental conditions and output a signal (e.g., an electrical signal) to the control unit representing the set of environmental conditions. The sensor kit can also include a set of cable connectors configured to enable electrical coupling of the accessory to the control unit (e.g., via the edge connector). The processer can then receive these signals, output by the sensor, and trigger output of a detectable response (e.g., a visual or audible response) according to instructions programmed by the user (e.g., via the companion application).

For example, the sensor kit can include: a wand accessory (e.g., a "magic" wand) including a color sensor configured to trigger a set of LED lights installed on the doll's clothing and/or accessories (e.g., dress, skirt, shirt, shoes, hat, jewelry)—and electrically coupled to the control unit—to output light of a particular color responsive to the user locating an object of the particular color in view of the color sensor; a flashlight accessory including an array of LED lights and a light sensor configured to trigger the array of LED lights to output light responsive to a light level (e.g., brightness) in the external environment falling below a threshold light level; a thermometer accessory including a temperature sensor configured to trigger rendering of a current temperature reading on the display responsive to selection of a particular input feature on the interface by the user; an earbud accessory including a sound sensor configured to trigger output of audible feedback (e.g., clapping, whispering, shouting) from the speaker at a volume proportional a current volume of noise detected in the external environment; etc.

By thus integrating these sensors into accessories that can be coupled to (e.g., "held" or "worn" by) the user's doll and that resemble real-world objects and/or common doll accessories, the user may be more likely to engage or actively play with these sensors and her doll—thereby eliciting positive feedback from the user—which may encourage the user to continue programming additional functionalities for these sensors and/or other sensors included in the sensor kit.

In one implementation, the sensor kit can include accessories associated with tasks and/or activities commonly enjoyed by children and/or, in particular, commonly enjoyed by young girls. For example, the sensor kit can include accessories configured to encourage play between the user (e.g., a child) and other users, such as the user's parent, sibling(s), and/or friend(s). In particular, in one example, the sensor kit can include a gardening accessory (e.g., a gardening tool) configured to promote engagement between the user and the doll while the user's parent attends to her garden, such that the user may mimic her parent's actions. In another example, the sensor kit can include a health-related accessory (e.g., a thermometer, a stethoscope, a mask) configured to promote engagement between the user and her sibling or her friend, such that these users may "play doctor" together. The sensor kit can therefore be tailored to children (e.g., young girls) to further promote engagement between the user (e.g., a young girl) and her doll assembly 100, thereby increasing opportunities for learning—such as related to science, technology, engineering, and/or mathematics—for this user.

In another implementation, the doll assembly 100 can include a sensor kit associated with a particular theme. For example, the doll assembly 100 can include a first "doctor" kit including a thermometer accessory (e.g., including a temperature sensor) and a stethoscope accessory (e.g., including a pulse sensor); a "classroom" kit including a backpack accessory (e.g., including a color sensor) and a book accessory (e.g., including a noise sensor); a "detective" kit including a pen accessory (e.g., including a noise sensor) and a magnifying glass accessory (e.g., including a distance sensor); a "gardening" kit including a watering can accessory (e.g., including a soil moisture sensor) and a visor accessory (e.g., including a light sensor); etc. In this implementation, by incorporating themed sensor kits, the system can enable the user to select a sensor kit—associated with a particular theme—matched to the user's interests and/or setting.

4.1 Suite of Sensors

In one implementation, the sensor kit can include a suite of sensors—each sensor, in the suite of sensors, integrated into a particular accessory—configured to output signals (e.g., electrical signals) indicative of various conditions or stimuli (e.g., optical, sounds, movement, physical presence) in an environment.

In one implementation, the suite of sensors can include a color sensor configured to detect a color of an object arranged proximal (e.g., within a field of view of) the sensor and output a signal indicating detection of the color. For example, the sensor kit can include a color sensor (e.g., an optical sensor) integrated within a wand (e.g., a toy wand) configured to attach to the doll. In this example, the wand can include a connector—electrically coupled with the color sensor—configured to insert into a corresponding connector receptacle arranged on a region of the housing corresponding to the doll's hand, such that the doll appears to hold the wand in her hand when the connector is inserted into the corresponding connector receptacle by the user. The user may initially access the companion application on a computing device (e.g., a smart phone, a tablet, a laptop, a desktop computer) to program instructions for processing of signals received from the color sensor. Then, upon completion of programming of the color sensor (e.g., programming of the control unit for operation of the color sensor) and connection of the connector with connector receptacle, the user may test the color sensor by positioning her forearm—covered by a sleeve of the user's shirt—proximal (e.g., within one inch, within one foot) and in view of the color sensor. Then, the system (e.g., the control unit) can: access a color (e.g., in the visible light spectrum) of the user's sleeve recorded by the color sensor; and trigger a set of LED lights—such as arranged on the display and/or arranged on various accessories (e.g., jewelry, shoes, clothing, backpack) connected to the housing and electrically connected to the control unit—to emit light matched to the color of the user's sleeve. In particular, in this example, if the user is wearing a red shirt, the system can trigger the set of LED lights to emit red light. Alternatively, in this example, if the user is wearing a blue shirt, the system can trigger the set of LED lights to emit blue light.

Additionally and/or alternatively, in another implementation, the sensor kit can include a pulse sensor configured to detect and/or monitor a pulse of the user in response to user contact (e.g., with a finger) with the pulse sensor. For example, the sensor kit can include a pulse sensor (e.g., an optical sensor) integrated within an accessory—such as a heart-shaped body and/or a toy stethoscope—configured to attach to the doll. Then, upon completion of programming of the pulse sensor and connection of the pulse sensor with the doll, the user may test the pulse sensor by contacting the pulse sensor with her index finger. Then, the system (e.g., the control unit) can: interpret a heart rate of the user based on a series of pulses recorded by the pulse sensor; and trigger rendering of the heart rate on the display. Alternatively, in another example, the system can leverage the pulse sensor to execute a "lie-detector test" and report results of the test to the user. In particular, the system can: predict that the user told a lie (e.g., in response to a question posed by another user) in response to interpreting a relatively high heart rate for the user; predict that the user told a truth in response to interpreting a relatively low or moderate heart rate for the user; and output a detectable signal—indicating prediction of the lie or the truth—accordingly, such as by triggering rendering "LIE" or "TRUTH" on the display and/or by triggering rendering of a red light to indicate a lie or rendering of a green light to indicate a truth.

Additionally and/or alternatively, in another implementation, the sensor kit can include a soil moisture sensor configured to detect presence of moisture in soil in response to insertion of the soil moisture sensor in the soil. For example, the sensor kit can include a soil moisture sensor integrated within an accessory configured to couple with the doll. In particular, in this example, the accessory can include: a body (e.g., a doll-sized watering can, a leaf-shaped body, a plant-shaped body) configured to couple with the doll; and a probe—extending from the body—configured to insert into soil and including the soil moisture sensor. Upon completion of programming of the soil moisture sensor and connection of the body with the doll, the user may test the moisture sensor by inserting the probe into soil (e.g., of a potted plant, in a garden). Then, the system (e.g., the control unit) can: interpret moisture content of the soil based on moisture data recorded at the soil moisture sensor; and trigger output of a detectable signal—representing the detected moisture content—to the user, such as by rendering a graphic indicative of the moisture content on the display and/or by triggering activation of a green light, yellow light, or red light on the accessory in response to the moisture content corresponding to a high, moderate, or low moisture content, respectively.

Additionally and/or alternatively, in yet another implementation, the sensor kit can include a distance sensor (e.g., a UV distance sensor) configured to detect a distance between the distance sensor and a physical object. For example, the sensor kit can include an ultrasonic sensor configured to detect a position of the user's hand relative the ultrasonic sensor. The ultrasonic sensor can be installed on an instrument (e.g., a Theremin) configured (e.g., programmed) to output sounds based on the user's hand position when coupled with the doll.

Additionally and/or alternatively, in yet another implementation, the sensor kit can include a sound sensor configured to detect a volume of sounds generated within a particular distance range of the sound sensor. For example, the sensor kit can include a sound sensor configured to detect a magnitude of sound waves within a threshold distance of the sound sensor. The sound sensor can be installed on a disco ball—including a set of LED lights—or a strobe light configured (e.g., programmed) to emit light at a brightness level proportional the magnitude of sound waves, detected by the sound sensor, when coupled with the doll.

Additionally and/or alternatively, in yet another implementation, the sensor kit can include a light sensor configured to detect a brightness (e.g., intensity) of light in an environment containing the light sensor. For example, the sensor kit can include a light sensor—configured to detect a brightness level of light in a room—installed on an accessory (e.g., a glowstick, a flashlight, a lantern, an electric candle) configured (e.g., programmed) to emit light at a brightness level inversely proportional to the brightness level detected in the room by the light sensor.

The sensor kit can include any combination of sensors, in the suite of sensors, such as a color sensor, a pulse sensor, a moisture sensor, a distance sensor, a sound sensor, and/or a light sensor. However, the sensor kit can include any other type of sensor in the suite of sensors.

5. User Onboarding & Education

The doll assembly 100 can interface with the companion application (e.g., a native application or web application)—executing on the user's computing device—to receive instructions, programmed by the user, for processing of signals (e.g., electrical signals) generated by sensors coupled to the doll. For example, once the doll assembly 100 is received by the user, the user and/or an adult supervisor associated with the user can download the companion application to her computing device (e.g., laptop, tablet, smartphone, desktop computer), such as by: wirelessly pairing her computing device to the doll assembly 100; scanning a QR code—included in packaging contents and/or on a component of the doll assembly 100—to register the doll assembly 100 to the computing device; or by manually entering a unique code—included in packaging contents and/or on a component of the doll assembly 100)—to register the doll assembly 100 to the computing device. Once the doll assembly 100 is registered and connected to the user's computing device, the user and/or the adult supervisor can create a new profile for the doll within the companion application and manually populate the new profile with various information, such as: a name of the user and/or a name of the user's doll; an age range of the user; a programming experience level of the user; a particular set of accessories currently owned by the user; etc.

In one implementation, the system can configure a series of tutorials (e.g., programming tutorials) for the user—each tutorial configured to provide instructions for programming (e.g., coding within the companion application) of a particular sensor according to a particular functionality, transmitting data to the control unit of the doll, and/or installing the particular sensor on the doll—based on information provided by the user in the user profile, such as based on an age range of the user, a programming experience level of the user, and/or a set of accessories owned by the user. Alternatively, in another implementation, the system can enable the user to select a particular tutorial, such as from a set of suggested or filtered tutorials and/or from all available tutorials.

5.1 Skill Level

In one implementation, the system can be configured to suggest tutorials and/or tasks to the user based on a skill level of the user. In this implementation, the system can track the user's progress over time and selectively enable access and/or selectively surface different projects to the user over time based on this progress. For example, at a first time, the system can prompt the user (e.g., via the companion application) to initiate a first protocol—corresponding to a low difficulty level—configured to provide instructions to the user for programming a touch sensor (e.g., a capacitive sensor) installed on a first accessory—configured to attach to the user's doll—including an LED light configured to turn on and off responsive to user contact with the light sensor. In response to completion of the first protocol, the system can prompt the user to test the touch sensor, such as by contacting the touch sensor with her index finger. Then, in response to receiving confirmation of functionality of the touch sensor (e.g., from the user), the system can: record completion of the first protocol; and suggest a second protocol—corresponding to the low difficult level—configured to provide instruction to the user for programming a sound sensor (e.g., installed on a second accessory). Therefore, the system can enable the user to practice skills at the low difficulty level before advancing to a higher difficulty level, while minimizing boredom experienced by the user—such as due to completion of repetitive programming protocols—by enabling the user to program and/or play with different types of sensors and/or accessories installed on her doll.

5.2 Test Exercises

In one implementation, the system can prompt the user to complete an exercise or "mission" configured to promote user engagement with the doll—such as with a particular sensor or sensors programmed by the user—and enable user verification of functionality of these sensors. In one example, the system can provide instructions for programming a heat sensor integrated into an accessory configured to attach to the housing. The system can then prompt the user to test the heat sensor—attached to the user's doll—by locating her doll in various regions of the user's current environment (e.g., home, classroom, outdoors). In particular, in this example, the system can prompt the user (e.g., via a video tutorial viewed by the user, via notification within a native application) to "find the warmest location in the house," "find the coldest location in the house," and/or "test the heat sensor by bringing your doll outside and inside the house." Additionally and/or alternatively, in a similar example, the system can provide instructions for programming a light sensor integrated into an accessory configured to attach to the housing. The system can then prompt the user to test the light sensor—attached to the user's doll—by locating her doll in various regions of the user's current environment. In particular, in this example, the system can prompt the user to "find the brightest region in the house," "find the darkest region in the house," "try testing the light sensor at night" and/or try testing the light sensor during the day."

In yet another example, the user may view a tutorial configured to instruct the user to program a noise sensor. In this example, the noise sensor can be integrated within a bracelet—configured to be "worn" by the doll—including a set of LED lights configured to emit light at a brightness level proportional to a noise level of an environment containing the doll. Within this tutorial (e.g., after completion of programming of the noise sensor), the system can prompt the user to: couple the bracelet to the doll—such as via a connector receptacle integrated within a region of the housing corresponding to the doll's "wrist"—to the doll; and test functionality of the noise sensor. For example, the system can output a prompt (e.g., included in the tutorial) stating: "Find the quietest location in your house," "find the quietest location in your house," "Speak to your doll as quietly as possible," and/or "shout as loud as possible."

In the preceding example, the system can therefore encourage the user to test functionality of the noise sensor by visually confirming changes in the brightness level of the LED lights on the bracelet responsive to the changes in noise level within the environment.

6. Companion Mode: Child & Adult User Education

In one variation, the system can enable and/or promote interactions between multiple users and the doll assembly 100. In particular, the system can enable multiple users—such as a child user (e.g., an owner of the doll) and an adult user (e.g., associated with the child user)—to access the companion application and/or engage independently and/or in tandem in programming, installation, and/or in playing with the doll assembly 100.

In one example, the system can serve a first tutorial—configured to enable the child user to write a first program configured to instruct pulsing of an LED light (e.g., on the display and/or on a ring accessory coupled to the doll) at a rate proportional a sound level recorded by a sound sensor in a headset accessory coupled to the doll—to the child user via a primary user portal accessible to the child user within the companion application. The system can additionally provide a second tutorial—configured to provide a general overview of functionality of the sound sensor, a set of troubleshooting guidelines configured to enable the adult user to provide guidance to the child user, and/or a set of exercises configured to test the child user's knowledge of skills learned in the first tutorial—to the adult user via a secondary user portal accessible to the adult user within the companion application.

In particular, in the preceding example, the system can: transmit a notification to the adult user (e.g., via the secondary user portal) indicating that the child user has completed the first tutorial and prompting the adult user to watch the second tutorial accordingly; and prompt the adult user—within the second tutorial—to ask the child user to demonstrate functionality of the sound sensor by engaging in play with child user and the doll. Additionally and/or alternatively, in this example, the system can prompt the adult user to ask the child user to write a second program configured to instruct pulsing of the LED light at a rate inversely proportional the sound level recorded by the sound sensor. The system can therefore: inform the adult user of tutorials completed and/or skill progression of the child user; enable coaching of the child user by the adult user; promote involvement of the adult user in testing, learning and/or play with the doll assembly 100 and the child user; and/or provide tools for the adult user to continue developing the child user's skills and/or knowledge of components (e.g., hardware, software) of the doll assembly 100 while enabling the adult user to encourage and/or bond with the child user.

6.1.1 Parental Figure+Child

In one implementation, the system can enable a parent to engage in learning and/or play of his or her child with the doll assembly 100. For example, a parent may access a parent portal, within the companion application, including: a set of parent tutorials—highlighted for the parent to watch—corresponding to a set of user tutorials completed by the parent's child; and/or a set of parental controls—such as including a volume control (e.g., a maximum volume of sound output from the speaker on the doll), an LED control configured to control a brightness of the display, a power control configured to enable the parent to disable the doll (e.g., for a specified duration, at preset time intervals, instantly), etc.—configured to enable the parent to control operation of the doll.

In a similar implementation, the system can enable a grandparent to engage in learning and/or play of his or her grandchild with the doll assembly 100. For example, a grandparent may access a grandparent portal, within the companion application, including: a grandparent tutorial configured to provide a general overview of functionality of the doll assembly 100; and a set of suggested exercises for the grandparent and the grandchild to complete together configured to promote mutual engagement with the doll assembly 100.

In each of these implementation, the system can modify content served to the adult user based on an identity of the adult user and/or perceived skill level of the adult user. Therefore, by serving this tailored content to the adult user—such as at a particular resolution, specificity, and/or difficulty level matched to this adult user—the system can enable engagement of the adult user with the doll assembly 100 without overwhelming and/or intimidating the adult user, thereby encouraging the adult user to engage in play and/or learning activities executed by the child user at the doll assembly 100.

6.1.2 Teacher+Student

In another implementation, the system can enable a teacher to engage in learning and/or play of a student with the doll assembly 100. For example, a teacher may access a teacher portal, within the companion application, including: a set of student profiles, corresponding to a set of students, selectable by the teacher, each student profile, in the set of student profiles, including copies of each program coded by the student and a list of tutorials completed by the student; a progress bar configured to demonstrate progress through a set of tutorials of each student in the set of students; a feedback section including questions or comments received from students; a set of tutorials—highlighted for the teacher to watch before a next lesson period—corresponding to an set of user tutorials to be completed by the set of students during the next lesson period; and/or a set of teacher controls (e.g., a volume control, an LED control, a power control) configured to enable the teacher to control operation of each doll, in a set of dolls, accessed by the set of students.

The systems and methods described herein can be embodied and/or implemented at least in part as a machine configured to receive a computer-readable medium storing computer-readable instructions. The instructions can be executed by computer-executable components integrated with the application, applet, host, server, network, website, communication service, communication interface, hardware/firmware/software elements of a user computer or mobile device, wristband, smartphone, or any suitable combination thereof. Other systems and methods of the embodiment can be embodied and/or implemented at least in part as a machine configured to receive a computer-readable medium storing computer-readable instructions. The instructions can be executed by computer-executable components integrated by computer-executable components integrated with apparatuses and networks of the type described above. The computer-readable medium can be stored on any suitable computer readable media such as RAMs, ROMs, flash memory, EEPROMs, optical devices (CD or DVD), hard drives, floppy drives, or any suitable device. The computer-executable component can be a processor but any suitable dedicated hardware device can (alternatively or additionally) execute the instructions.

As a person skilled in the art will recognize from the previous detailed description and from the figures and claims, modifications and changes can be made to the embodiments of the invention without departing from the scope of this invention as defined in the following claims.

I claim:

1. A doll assembly comprising:

a doll comprising:

a doll housing comprising:

a set of connector receptacles;

a central body defining a central cavity; and a set of appendages flexibly coupled with the central body and defining a set of channels extending from the central cavity toward the set of connector receptacles;

a core receptacle arranged within the central cavity;

a control unit configured to engage the core receptacle to seat within the central cavity and comprising:

a processor configured to process signals according to a set of instructions programmed by a user and received from a companion application executing on a computing device accessed by the user;

a communication module configured to enable wireless communication between the control unit and the companion application;

a power supply configured to supply power to the doll assembly including the control unit and the set of connector receptacles; and an edge connector configured to receive a set of cable connectors to electrically couple the set of connector receptacles to the control unit; and the set of cable connectors configured to seat within the set of channels and defining a first end, configured to couple to the control unit, and a second end, configured to couple to the set of connector receptacles; and a sensor kit comprising a first accessory, in a set of accessories, comprising:

a color sensor configured to:

output a first signal, to the control unit, responsive to presence of a first object of a first color in a field of view of the color sensor; and output a second signal, to the control unit, responsive to presence of a second object of a second color in the field of view of the color sensor; and a first connector configured to transiently engage a first connector receptacle, in the set of connector receptacles, to electrically couple the color sensor to the control unit.

2. The system of claim 1:

wherein the control unit is configured to:

trigger generation of a first detectable response, associated with presence of the first color, responsive to receiving the first signal, based on a first subset of instructions, in the set of instructions, corresponding to the color sensor; and trigger generation of a second detectable response, associated with presence of the second color, responsive to receiving the second signal, based on the first subset of instructions;

further comprising a second accessory, in the set of accessories, comprising:

a moisture sensor configured to:

output a third signal, to the control unit, responsive to detection of a first moisture level in soil; and output a fourth signal, to the control unit, responsive to detection of a second moisture level in soil; and a second connector configured to transiently engage a second connector receptacle, in the set of connector receptacles, to electrically couple the moisture sensor to the control unit;

further comprising a third accessory, in the set of accessories, comprising:

a sound sensor configured to:

output a fifth signal, to the control unit, responsive to detection of a first noise level in an environment containing the second sensor; and output a sixth signal, to the control unit, responsive to detection of a second noise level in the environment containing the second sensor; and a third connector configured to transiently engage a third connector receptacle, in the set of connector receptacles, to electrically couple the sound sensor to the control unit; and wherein the control unit is configured to:

trigger generation of a third detectable response, associated with the first moisture level, responsive to receiving the third signal, based on a second subset of instructions, in the set of instructions, corresponding to the moisture sensor;

trigger generation of a fourth detectable response, associated with the second moisture level, responsive to receiving the fourth signal, based on the second subset of instructions;

trigger generation of a fifth detectable response, associated with the first noise level, responsive to receiving the fifth signal, based on a second subset of instructions, in the set of instructions, corresponding to the sound sensor; and trigger generation of a sixth detectable response, associated with the second noise level, responsive to receiving the sixth signal, based on the second subset of instructions.

* * * * *